United States Patent [19]

Aizawa et al.

[11] 4,428,054

[45] Jan. 24, 1984

[54] AUTOMATIC CONTROL METHODS AND DEVICES FOR ROLLING HILLS

[75] Inventors: Hitoshi Aizawa, Kobe; Masaaki Takarada, Akashi, both of Japan

[73] Assignee: Kawasaki Steel Corporation, Hyojo, Japan

[21] Appl. No.: 258,779

[22] Filed: Apr. 29, 1981

[30] Foreign Application Priority Data

| | | | |
|---|---|---|---|
| Nov. 5, 1979 | [JP] | Japan | 54-143142 |
| Dec. 17, 1979 | [JP] | Japan | 54-163855 |
| Dec. 17, 1979 | [JP] | Japan | 54-163856 |

[51] Int. Cl.[3] ..... B21B 37/12; G05D 5/03; G06F 15/46

[52] U.S. Cl. ..... 364/472; 72/8; 72/16; 364/160; 364/180

[58] Field of Search ..... 364/468, 469, 472, 160, 364/180; 72/6–12, 16

[56] References Cited

U.S. PATENT DOCUMENTS

| | | | |
|---|---|---|---|
| 3,802,236 | 4/1974 | Smith, Jr. | 72/11 |
| 4,037,087 | 9/1977 | Foulds | 364/472 X |
| 4,106,318 | 8/1978 | Yanagimoto et al. | 364/472 X |
| 4,126,026 | 11/1978 | Fapiano | 364/472 X |
| 4,220,025 | 9/1980 | Baga et al. | 364/472 X |
| 4,240,147 | 12/1980 | Morooka et al. | 364/472 |

*Primary Examiner*—Joseph F. Ruggiero

*Attorney, Agent, or Firm*—Parkhurst & Oliff

[57] ABSTRACT

In methods of automatically controlling the strip thickness in a rolling mill for producing a rolled product having a desired thickness and devices therefore, either an automatic gauge control (AGC) mode for controlling a deviation of the output thickness of a material being rolled from the predetermined desired uniform gauge thickness to be diminished to zero or an automatic reduction rate control(ARC) mode for controlling the rate of reduction of the material being rolled to a predetermined value is properly selected in accordance with the rolling condition, i.e., the degree of the actually measured output thickness deviation of the material or the progress of the rolling passes. Furthermore, as a method of and a device for automatically controlling the rate of reduction suitable for the ARC mode of the methods of and the devices for automatically controlling the strip thickness, the rate of reduction is controlled such that an output thickness of the material is calculated from an actually measured input thickness of the material and a desired rate of reduction based on the principle of the constant mass-flow rate of the material being rolled, an input thickness is estimated from the calculated output thickness, an input length and an output length, and an error signal between the estimated input thickness and the actually measured input thickness is diminished to zero.

16 Claims, 12 Drawing Figures

FIG. 2
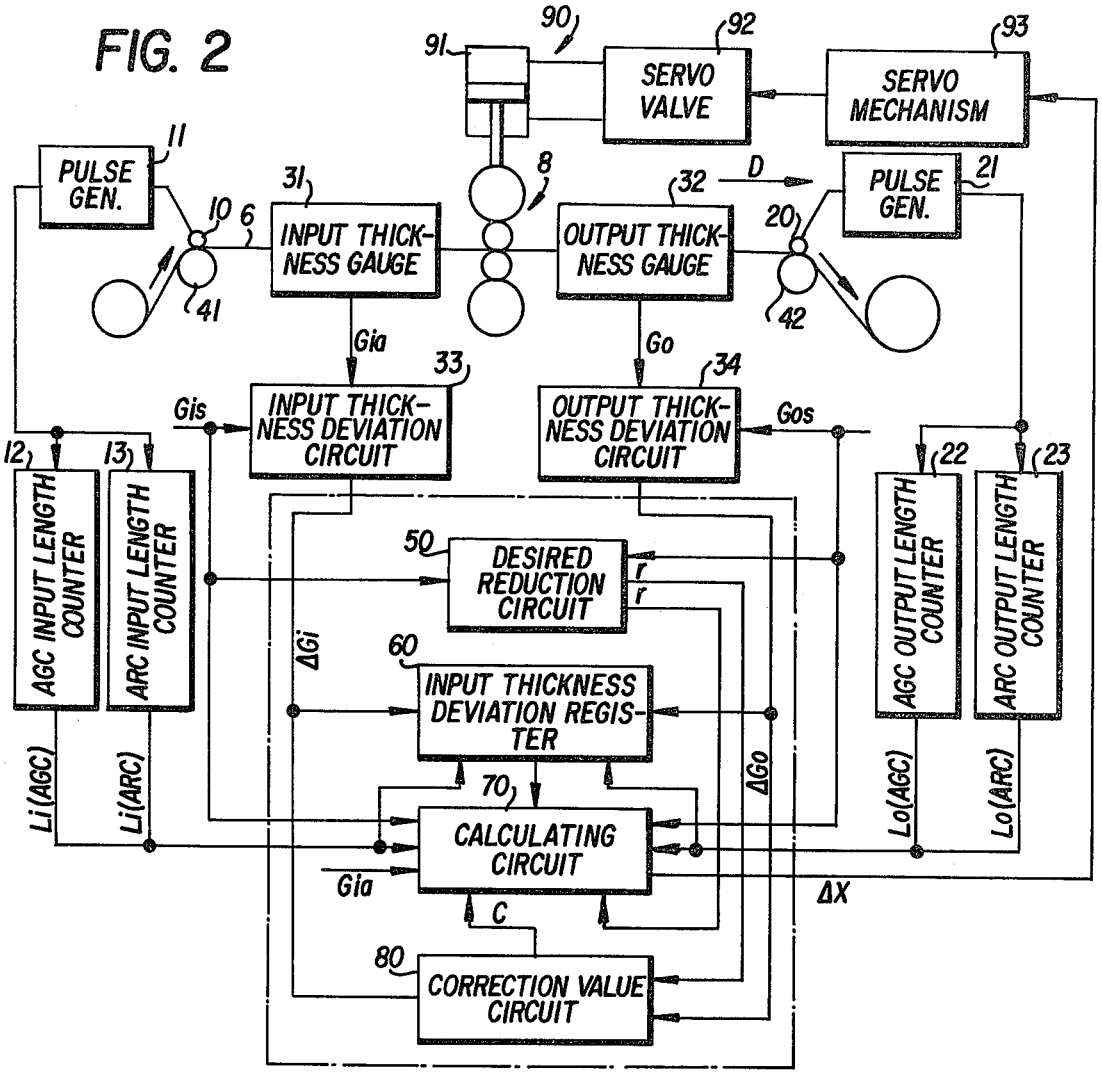
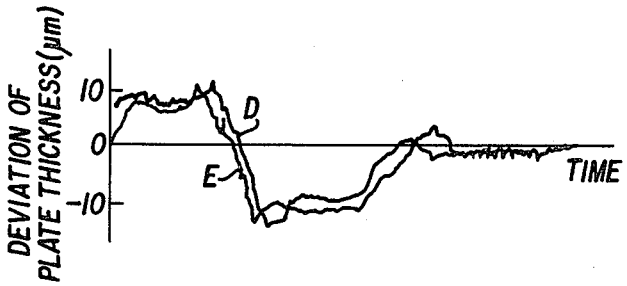
FIG. 7
FIG. 8
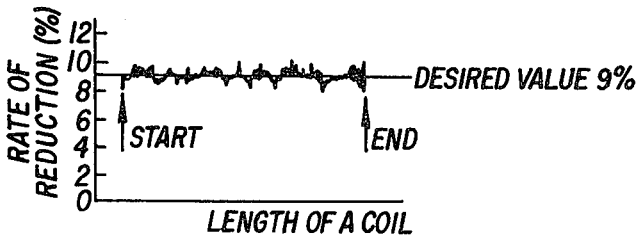

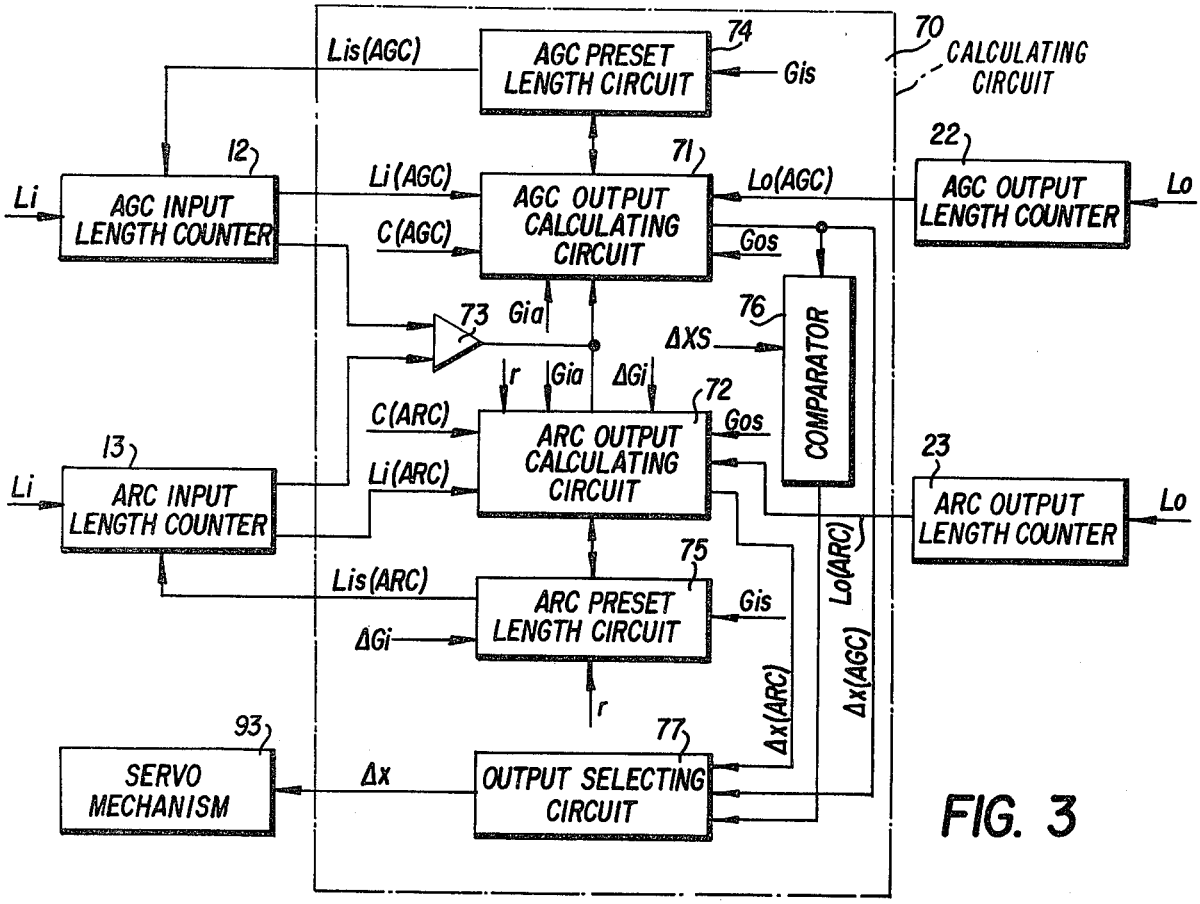
FIG. 3
FIG. 4
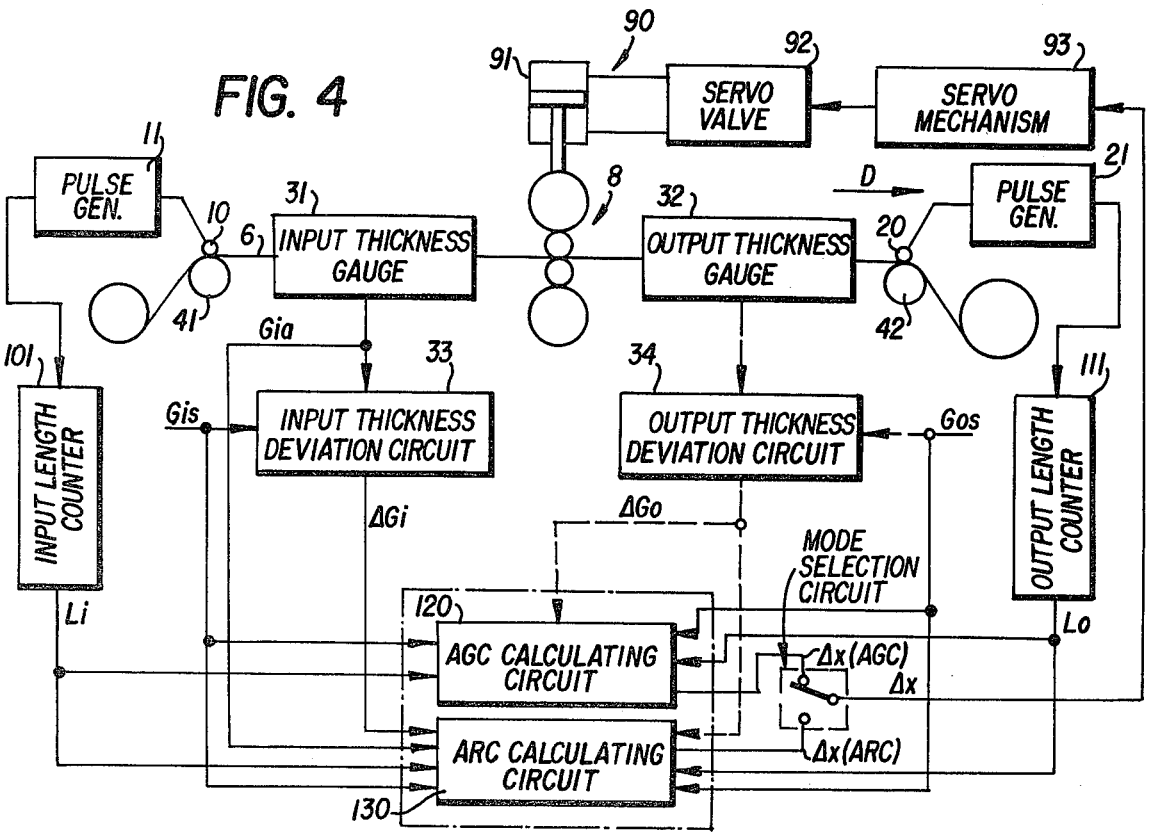

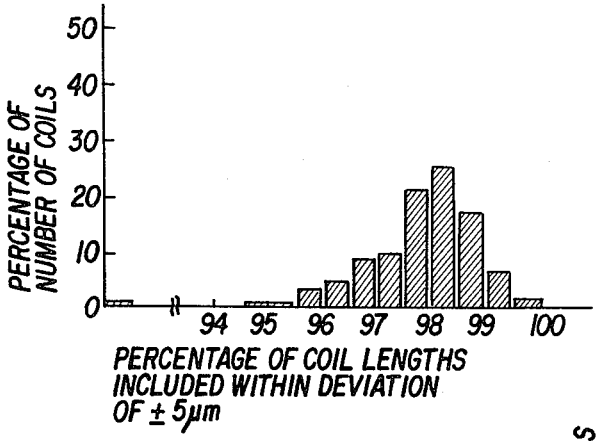
FIG. 5(a)
FIG. 5(b)
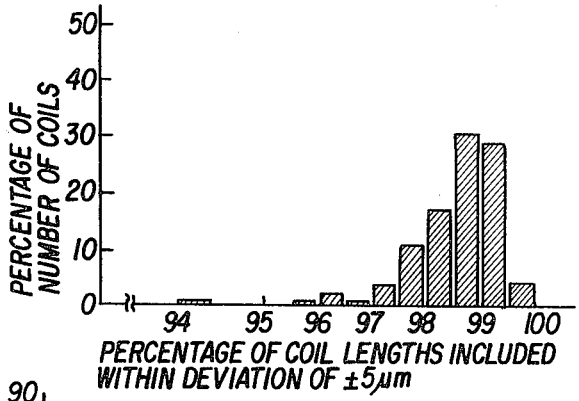
FIG. 6
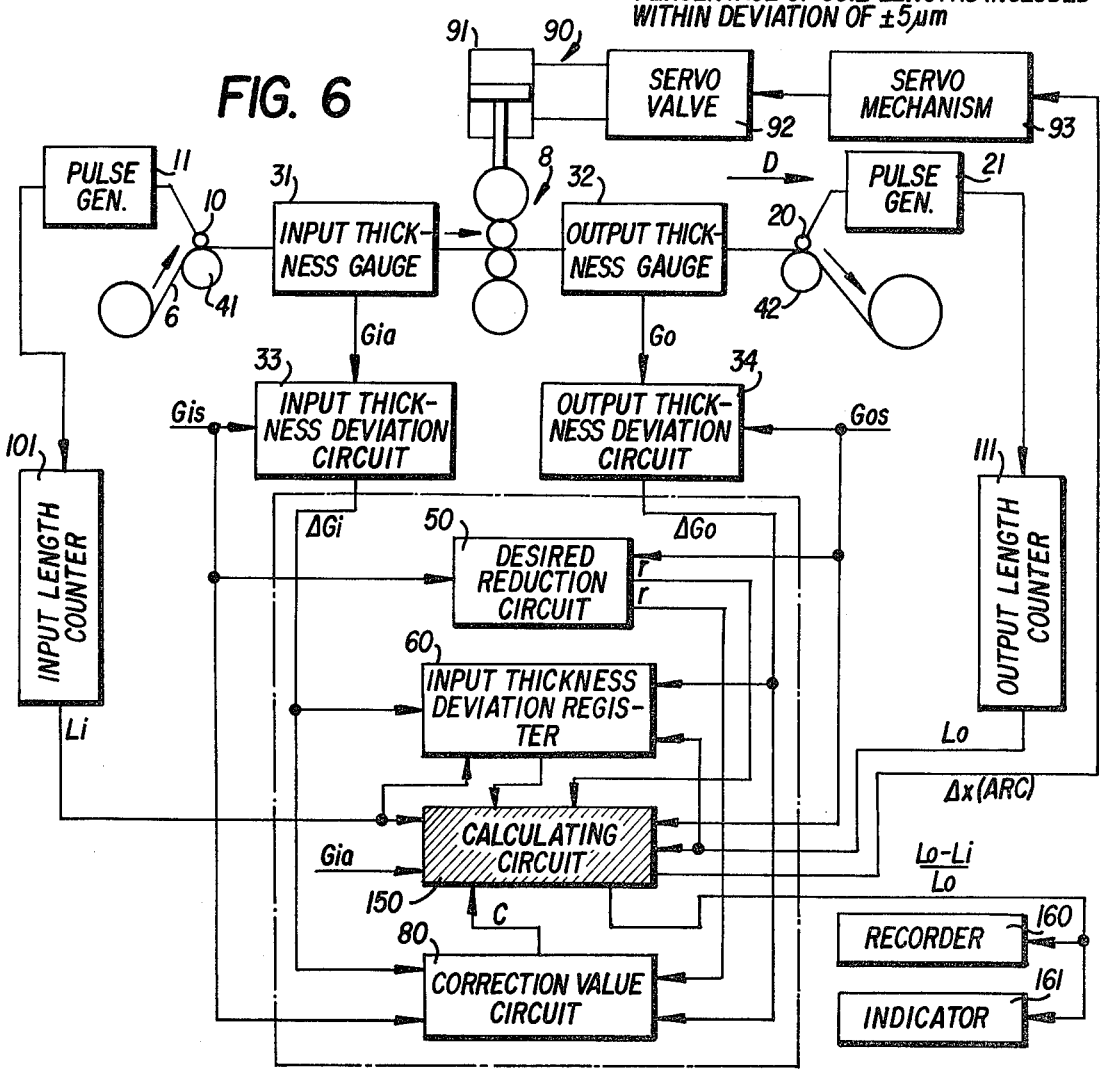

AUTOMATIC CONTROL METHODS AND DEVICES FOR ROLLING HILLS

BACKGROUND OF THE INVENTION

1. Field of the Invention

The present invention relates to automatic control methods and devices for rolling mills, and particularly to automatic strip thickness control methods for obtaining a rolled product having a desired thickness by means of a Sendzimir mill for rolling an electrical steel sheet or stainless steel sheet, apparatuses for carrying out the methods, an automatic reduction rate control method for a rolling mill for rolling a material to be rolled at a predetermined rate of reduction, and an apparatus for carrying out the method.

2. Description of the Prior Art

In recent years, it has become desirable to provide improved accuracies in plate thickness in the rolling of steel sheets by means of rolling mills, particularly, in the cold rolling of thin steel sheets such as an electrical steel sheet and a stainless steel sheet by means of Sendzimir mills, and consequently, it is desired to improve the accuracy in strip thickness control. As a method of controlling the strip thickness or a device therefore, there have, heretofore been employed automatic gauge control (hereinafter referred to as "AGC") for diminishing to zero the deviation in the output side strip thickness from a predetermined desired uniform gauge thickness and automatic reduction rate control (hereinafter referred to as "ARC") for rolling a material at a constant rate of reduction. The former AGC includes various types such as the so-called BISRA AGC, Feedback AGC, Massflow AGC and Forward AGC, each of which suffers from the following problems. Firstly, when the gain of the screwdown system is raised to improve the responsibility in controlling a loop system in the devices as described above, a hunting phenomenon due to an overshoot from the desired value in the reduction cylinder occurs, so that the accuracy in strip thickness is decreased as compared with the preceding pass. Secondly, when any one of the abovedescribed AGC's are is continuously employed in a reversing mill, the accuracy in strip thickness does not necessarily improve in a pass, as compared with the result of rolling in the preceding pass, as the number of the rolling passes is increased.

To solve the first problem, a simple method has been adopted of providing a dead band, and a more advanced method of the optimum rolling, in which the direction of reduction is changed over before the reduction cylinder has the overshot. In the former method, an output signal for control is emitted only when a preset value of deviation is exceeded, e.g., by $\pm 1 \sim \pm 2$ μm, however, there is such a disadvantage that, decreased dead band results in lowered effects and increased dead band does not result in the required accuracy in strip thickness, so that practically, it is difficult to attain an improvement in the accuracy in strip thickness by use of this method alone.

Particularly, in view of modern accuracy requirements in strip thickness for electrical steel sheet, difficulties are felt in providing a dead band larger than $\pm 1 \sim \pm 2$ μm in the aforesaid example, so that the provision of the dead band alone does not necessarily result in satsifactory effects. The latter method, optimum reduction, in which complex calculations are performed to switch control points, is an excellent automatic strip thickness control method. However, if it is required to shorten the sampling time, there may occur such a disadvantage that the time required for processing lacks because the calculations are complex.

To solve the second problem, the material is rolled at a low rolling speed when an AGC is continuously employed during a plurality of rolling passes. However, this method is not preferable because it results in lowered productivity. Further, in the case of the reversing mill, it is estimated that unsatisfactory controlling operation results when the signal of strip thickness of the preceding rolling pass is fed to the screwdown system of a constant response speed as an input (deviation) for the succeeding rolling. A hunting phenomenon may occur due to phase delay because of high frequency components over the responsibility of the screwdown system, and may result in lowered accuracy of strip thickness. To avoid this defect, the response of the screwdown system should be varied in accordance with the number of rolling passes. However, it is not easy to do so with the reversing mill of many passes because of the upper limit of the response of the screwdown system.

In contrast to the above, the aforesaid AGC corrects the input deviation by the value corresponding to the rate of reduction, whereby the output value of rate of reduction is low as compared with the aforesaid AGC's, so that the load of the screwdown system can be low, the responsibility enhanced and the stability improved. Particularly, if the strip thickness is controlled within a certain deviation ($\pm 10$ μm, $\pm 5$ μm, for example) in the preceding rolling, then the deviation can be decreased in accordance with the rate of reduction, so that a comparatively moderate control can be effected. With AGC in which a zero deviation is desired, an overshoot in the screwdown system takes place around the desired value, i.e., the so-called hunting phenomenon occurs. With ARC, such a phenomenon does not take place. However, with this ARC, there is a problem that the accuracy in controlling the strip thickness is lowered in the case of a high value of deviation.

For the materials to be rolled, respective pressure control reduction rates are preset according to the applications of the materials, and the rate of reduction has a great influence on the mechanical properties and other characteristics of a product. For example, in the temper rolling of a non-oriented electrical steel sheet, the rate of reduction displays a great influence on the magnetic characteristics. Consequently, with certain types of materials, there are some cases where the rate of reduction in the direction of rolling is required to be set at a predetermined value. A specific method of ARC, in which the rate of reduction is controlled at a predetermined value for use in the case as described above, is one in which the rate of reduction is detected to control the roll gap to become equal to the desired rate of reduction in the same manner as in the ordinary strip thickness control, in which the strip thickness at the output side of the mill is measured to control the rate of reduction. As the methods of measuring the rate of reduction in this case, there have, heretofore, been known a method of measuring the rate of reduction by use of a strip thickness gauge, a method of measuring the percentage of elongation from the strip length or strip speed by use of deflector rolls, etc. With ARC by use of the former, the position, where the strip thickness gauge is provided, is apart from the positions of work rolls, whereby a delay in time takes place due to the travel of the material therebetween, thus deteriorating the controllability. With ARC by use of the latter, errors occurring due to slip between the deflector rolls and the steel sheet and the difference between the diameters of rolls hamper the accurate measurement of the percentage of elongation. Further, it is difficult to correct the errors during rolling. Moreover, no data on the input side strip thickness are rendered, whereby the controllability on the disturbance such as a change in input thickness is low, which, in an extreme case, may cause an accident of a sheet break. In addition, another ARC obtains a constant rate of reduction by rolling at a predetermined pressure by use of an accumulator and rolls of low elasticity. However, particularly, the mills having a multi-roll arrangement have hysterisis due to friction and looseness, thus presenting a disadvantage that a constant rate of reduction is not easily obtainable.

SUMMARY OF THE INVENTION

One of the objects of the present invention is, therefore, to provide a method of automatically controlling the strip thickness in a rolling mill, capable of overcoming the disadvantages of AGC and ARC, and having excellent in the accuracy in strip thickness, responsibility and stability.

Another object of the present invention is to provide a method of automatically controlling the strip thickness in a rolling mill, capable of properly using an AGC mode and ARC mode according to the condition of a material to be rolled.

Still another object of the present invention is to provide a method of automatically controlling the strip thickness in a rolling mill, wherein AGC mode passes and ARC mode passes are properly arranged in accordance with the process of rolling during rolling of a plurality of passes, the productivity is not hampered by decreased rolling speed, and the accuracy in strip thickness is improved as the number of rolling passes is increased.

A further object of the present invention is to provide a method of automatically controlling the rate of reduction in a rolling mill, capable of carrying out rolling at a constant rate of reduction being suitable for use as ARC in the abovementioned methods of automatically controlling the strip thickness, and yet, being stabilized with high accuracy.

A still further object of the present invention is to provide a method of automatically controlling the rate of reduction, capable of obviating the steady variations from the desired value in the rate of reduction due to errors in measurement of the strip length, changes in strip width or the like in the abovementioned method of automatically controlling the rate of reduction.

A yet further object of the present invention is to provide a device suitable for working the abovementioned methods of automatically controlling the strip thickness or the aforesaid method of automatically controlling the rate of reduction.

A still further object of the present invention is to provide devices for automatically controlling the strip thickness or a device for automatically controlling the rate of reduction, both of which do not require the setting of the desired rate of reduction.

A yet further object of the present invention is to provide a device for automatically controlling the rate of reduction, having reduction rate indicating means capable of indicating the rate of reduction by use of a simplified mechanism even when the position of a strip thickness gauge is apart from the position of work rolls.

One of the abovedescribed objects can be achieved when, in a method of automatically controlling the strip thickness in a rolling mill for producing a rolled product having a desired thickness, either an AGC mode for controlling a deviation of the output thickness of a material being rolled from the predetermined desired uniform gauge thickness to be diminished to zero or an ARC mode for controlling the rate of reduction of the material being rolled to a predetermined value is properly selected in accordance with the rolling condition.

Further, one of the abovedescribed objects can be achieved when a reference deviation of the output thickness of the material being rolled from the predetermined desired uniform gauge thickness is set, the aforesaid AGC mode is selected when an actually measured deviation of the output thickness exceeds the aforesaid reference deviation, and the aforesaid ARC mode is selected when an actually measured deviation of the output thickness does not reach the aforesaid reference deviation. A control output of ARC is less than that of AGC principally, so that the load of the reduction system is low, with the responsibility and the stability being improved. However, in ARC, there remains a deviation which corresponds to a dead band and the rate of reduction, and the absolute accuracy of the strip thickness is lowered to a large value of deviation. Consequently, a certain reference deviation is set as described above, and, if an actually measured deviation exceeds the reference deviation, then control is effected by use of the conventional AGC, while, if an actually measured deviation does not reach the reference deviation, then ARC is used in contrast to the above. If this reference deviation is set at $\pm 5$ $\mu$m, then the accuracy of controlling within $\pm 3$ $\mu$m can be obtained after two or three passes, and a stabilized controlling of the strip thickness can be achieved.

Further, one of the abovedescribed objects can be achieved by previously selecting for proper use either the AGC mode or the ARC mode for the respective passes.

FIG. 1 shows how the deviations in strip thickness in the case the screwdown servo-loop system is approximately, represented by a simple first order lag system having a delay time L in a reversing mill. FIGS. 1(*a*) and 1(*b*) show deviations in strip thickness at the input side and the output side during pass 1, while FIGS. 1(*c*) and 1(*d*) show deviations in strip thickness at the input side and output side during pass 2. In the case a delay time L is present in the reduction system, if AGC is continuously used, then a large overshoot occurs as indicated by a symbol A in FIG. 1(*d*) for example, which causes an unsatisfactory strip thickness. However, this delay time L is variable according to the conditions including the number of rolling passes, the type of material to be rolled and the like, and hence, it is very difficult to estimate the length of the delay time L and perform controlling according thereto. The output deviation indicated by broken lines in FIG. 1(*d*) is obtained in the case when a sheet having an input deviation as shown in FIG. 1(*a*) is rolled for pass 1 by use of AGC, and thereafter, rolled for pass 2 by use of ARC. In the case when ARC is employed after AGC as shown in the drawing, even if the delay time is present to some level, the overshoot is low as indicated by symbol B, so that AGC can work in a stabilized condition during the succeeding rolling.

Further, one of the abovedescribed objects can be achieved when, if the total number of the passes is an odd number of three or more, the aforesaid AGC mode is selected for pass 1, and, for pass 2 and thereafter, the ARC mode and AGC mode are alternately selected.

Further, one of the abovedescribed objects can be achieved when if in the total number of the passes is an even number of four or more, the aforesaid AGC mode is selected for pass 1 and pass 2, and, for pass 3 and thereafter, the ARC mode and AGC mode are alternately selected.

Further, one of the abovedescribed objects can be achieved when the AGC mode is selected for the former part of passes, the ARC mode is selected for the latter part of passes except the final pass, and the AGC mode is selected for the final pass.

Further, one of the abovedescribed objects can be achieved when the aforesaid ARC mode is adapted to control the rate of reduction in such a manner that an output thicknes of the material being rolled is calculated from an actually measured thickness of the material at the input side of the mill and the desired rate of reduction based on the principle of the constant mass-flow rate of the material being rolled, an input thickness of the material being rolled is estimated from the output thickness thus calculated, and an input length. The an output length, and difference between the estimated input thickness and an actually measured input thickness can thereby be diminished to zero.

Further, one of the abovedescribed objects can be achieved when, in the method of automatically controlling the rate of reduction in a rolling mill for rolling a material being rolled at a predetermined rate of reduction, the rate of reduction is controlled in such a manner that an output thickness of the material being rolled is calculated from an actually measured input thickness of the material and a desired rate of reduction based on the principle of the constant mass-flow rate of the material being rolled, an input thickness is estimated from the output thickness thus calculated, and an input length and an output length. The difference between the estimated input thickness and an actually measured input thickness can thereby be diminished to zero. In other words, there is no delay in time due to the travel of the material and calculation includes the input thickness, so that satisfactory response to the input thickness can be obtained.

Further, one of the abovedescribed objects can be achieved when the aforesaid estimated input thickness is feedback corrected by a correction value obtained by adding and averaging a difference between a calculated output thickness deviation and an actually measured thickness deviation over predetermined length of the material.

Further, one of the abovedescribed objects can be achieved by the device for automatically controlling the strip thickness in a rolling mill, comprising:

AGC input length detecting means for detecting an input length of a material being rolled for an AGC mode;

ARC input length detecting means for detecting an input length of the material for an ARC mode;

input thickness detecting means for detecting an actually measured input thickness of the material;

an input thickness deviation output circuit for feeding a difference between the actually measured input thickness fed from the input thickness detecting means and an input thickness reference value;

an input thickness deviation shift register for storing the input thickness deviations fed from the input thickness deviation output circuit, successively shifting same in accordance with the measured distances in response to output signals fed from the aforesaid input length detecting means, and feeding data immediately before the positions of work rolls;

a desired reduction output circuit for feeding a desired rate of reduction required for the ARC mode;

AGC output length detecting means for detecting the output length of the material being rolled for the AGC mode;

ARC output length detecting means for detecting the output length of the material being rolled for the ARC mode;

a calculating circuit including:

an AGC preset length output circuit for feeding an AGC preset length in accordance with the input thickness reference value to the aforesaid AGC input length detecting means;

an ARC preset length output circuit for feeding to the aforesaid ARC input length detecing means an ARC preset length calculated from the input thickness reference value, the desired rate of reduction fed from the desired reduction output circuit and the input thickness deviation fed from the input thickness deviation output circuit;

a gate for emitting an output when both the the AGC input length detecting means and the ARC input length detecting means have completed detections of the preset lengths;

an AGC output calculating circuit for initiating calculation in response to an output from the gate, calculating an estimated input thickness for the AGC mode from the input length fed from the AGC input length detecting means, the output length fed from the AGC output length detecting means and the output thickness reference value, and feeding an error signal between the estimated input thickness and the actually measured input thickness fed from the input thickness detecting means;

an ARC output calculating circuit for initiating calculation in response to an output from the gate, calculating an estimated input thickness for the ARC mode from the input length fed from the ARC input length detecting means, the output length fed from the ARC output length detecting means, the input thickness deviation immediately before the positions of work rolls fed from the input thickness deviation shift register, the output thickness reference value and the desired rate of reduction fed from the desired reduction output circuit, and feeding an error signal between the estimated input thickness and the actually measured input thickness fed from the input thickness detecting means;

a comparator for comparing an AGC error signal fed from the AGC output calculating circuit with an error reference value;

an output selecting circuit for feeding the AGC error signal fed from the AGC output calculating circuit when the error signal exceeds the reference error and feeding the ARC error signal fed from the ARC output calculating circuit when the error signal does not reach the reference error, in response to an output from the comparator; and a reduction apparatus for controlling the positions of work rolls in response to an output from the output selecting circuit of the calculating circuit.

Further, one of the abovedescribed objects can be achieved when a correction value calculating circuit is further included for obtaining a mean value of a difference between the output thickness reference value and the actually measured output thickness and feeding same as a feed back correction value for correcting error for the AGC mode, and obtaining a calculated output thickness deviation from the input thickness deviation fed from the aforesaid input thickness deviation output circuit and the desired rate of reduction fed from the aforesaid desired reduction output circuit and feeding a mean value of a difference between the calculated output thickness deviation and the actually measured output thickness deviation to the aforesaid reduction calculating circuit as a feedback correction value for correcting an error for the ARC mode.

Further, one of the abovedescribed objects can be achieved when the aforesaid desired reduction output circuit is made to calculate the desired rate of reduction from the input thickness reference value and the output thickness reference value.

Further, one of the abovedescribed objects can be achieved by the device for automatically controlling the strip thickness in a rolling mill comprising:

input length detecting means for detecting an input length of a material being rolled;

input thickness detecting means for detecting an actually measured input thickness of the material;

an input thickness deviation output circuit for feeding a difference between the actually measured input thickness fed from the input thickness detecting means and an input thickness reference value;

output length detecting means for detecting an output length of the material;

an AGC calculating circuit for calculating an estimated input thickness for the AGC mode from the input length fed from the input length detecting means, the output length fed from the output length detecting means and an output thickness reference value, and feeding an error signal between the estimated input thickness and the actually measured input thickness fed from the input thickness detecting means;

an ARC calculating circuit for calculating an estimated input thickness for the ARC mode from the input length fed from the input length detecting means, the output length fed from the output length detecting means; the input thickness deviation fed from the input thickness deviation output circuit, the output thickness reference value and the desired rate of reduction calculated from the input thickness reference value and the output thickness reference value, and feeding an error signal between the estimated input thickness and the actually measured input thickness fed from the input thickness detecting means;

a mode selection circuit for feeding an AGC error signal fed from the aforesaid AGC calculating circuit at the time of the AGC mode and feeding an ARC error signal fed from the aforesaid ARC calculating circuit at the time of the ARC mode, in accordance with the control mode predetermined for the respective rolling passes; and a reduction apparatus for controlling the positions of work rolls in response to an output from the mode selection circuit.

Further, one of the abovedescribed objects can be achieved by the device for automatically controlling the rate of reduction in a rolling mill, comprising:

input length detecting means for detecting an input length of a material being rolled;

input thickness detecting means for detecting an actually measured input thickness of the material;

an input thickness deviation output circuit for feeding a difference between the actually measured input thickness fed from the input thickness detecting means and the input thickness reference value;

an input thickness deviation shift register for storing the input thickness deviations fed from the input thickness deviation output circuit, successively shifting same in accordance with the measured distances in response to output signals fed from the aforesaid input length detecting means, and feeding data immediately before the positions of work rolls;

a desired reduction output circuit for feeding a desired rate of reduction;

output length detecting means for detecting an output length of the material;

a calculating circuit for initiating each time a predetermined length is detected by means of the aforesaid input length detecting means, calculating an estimated input thickness from the input length fed from the aforesaid input length detecting means, the output length fed from the output length detecting means, the input thickness deviation immediately before the positions of work rolls fed from the aforesaid input thickness deviation shift register, the output thickness reference value and the desired rate of reduction fed from the aforesaid desired reduction output circuit, and feeding an error signal between the estimated input thickness and the actually measured input thickness fed from the aforesaid input thickness detecting means; and a reduction apparatus for controlling the positions of work rolls in response to an output from the reduction circuit.

Further, one of the abovedescribed objects can be achieved when a correction value calculating circuit is further included for obtaining a calculated output thickness deviation from the input thickness deviation fed from the aforesaid input thickness deviation output circuit and the desired rate of reduction fed from the aforesaid desired reduction output circuit, and feeding mean value of a difference between the calculated output thickness deviation and the actually measured output thickness deviation to the aforesaid calculating circuit as a feedback correction value.

Further, one of the abovedescribed objects can be achieved when reduction indicating means is further included for indicating a rate of reduction calculated from the input length and output length.

Further, one of the abovedescribed objects can be achieved when the aforesaid desired reduction output circuit is made to calculate a desired rate of reduction from the input thickness reference value and the output thickness reference value.

In working the methods of automatically controlling the plate thickness according to the present invention, desirable AGC and ARC that are conventionally known can be employed. However, it is preferable that, in a rolling mill, AGC and ARC are simultaneously worked and the methods utilize the principle of the constant mass-flow rate of the material being rolled.

The principle of the constant mass-flow rate of the material being rolled is indicated by the following equation.

$$\rho iVi = \rho ibiGi\frac{Li}{\Delta t} = \rho oboGo\frac{Lo}{\Delta t} = \rho oVo \quad (1)$$

wherein, $\rho$ represents a density, b a strip width, G a strip thickness, L a strip length, $\Delta t$ a unit time, V a volume, and suffixes i, o attached thereto represent the input and output sides of the rolling mill, respectively.

If the assumption is made that the density and strip width of the material are not varied before and after the rolling, then an estimated input thickness Gic is obtained from the equation (1) as follows:

$$Gic = \frac{Lo}{Li}Go \quad (2)$$

Here, the input thickness Gi is divided into two values including an input thickness reference value Gis and an input thickness deviation $\Delta$Gi, and indicated by the following equation.

$$Gi = Gis + \Delta Gi \quad (3)$$

Then, in the case when the material is rolled at a desired rate of reduction r, an estimated output thickness Go is indicated by the following equation.

$$Go = Gos + \Delta Go = Gos + \Delta Gi(1-r) \quad (4)$$

Wherein Gos represents an output thickness reference value and $\Delta$Go an output thickness deviation. Consequently, in the case of control performed by ARC, the estimated input thickness Gic (ARC), when the equation (4) is substituted in the equation (2), is indicated by the following equation.

$$Gic\ (ARC) = \frac{Lo}{Li}\{Gos + \Delta Gi(1-r)\} \quad (5)$$

Additionally, in the case of control performed by AGC, the estimated input thickness Gic (AGC) is indicated by the following equation.

$$Gic\ (AGC) = \frac{Lo}{Li}Gos \quad (6)$$

The equations (5) and (6) show that, in both cases of control performed by ARC and AGC, the estimated input thicknesses Gic (ARC) and Gic (AGC) are obtainable from the rate of reduction r, the output thickness reference value Gos, the input thickness variation $\Delta$Gi, the input length Li and the output length Lo through calculation, respectively. Consequently, in both cases of ARC and AGC, the desired object can be achieved by that an input thickness Gia is actually measured, the result is compared with the aforesaid estimated input thickness Gic, and the positions of the work rolls are controlled so that the error signal $\Delta x = Gic - Gia$ can be diminished to zero at all times.

The aforesaid input thickness deviation $\Delta$Gi is obtained through actual measurement of the input thickness by use of a thickness gauge provided at the input side of the work rolls. However, the thickness gauge is spaced a predetermined distance apart from the work rolls. In consideration of correcting the delay due to the travel of the material for the predetermined distance, a thickness detection signal is processed so that the value immediately before the work rolls can be used at all times. By this, the position of the succeeding rolling can be reliably estimated, high responsibility attained, and control with high accuracy achieved.

While, when the measurement of strip length is performed by use of a pulse generator mounted on a rotary shaft of a small touch roll brought into contact withthe material being rolled, slip with the material is low because of a low inertia moment as compared with the case where direct detection is made from deflector rolls. However, due to the factors of error such as the difference in diameter between the touch rolls at the input and output sides, which is caused during the manufacturing process, changes caused by thermal expansion, changes in strip width which have been ignored when the equation (2) is introduced, or the like, to state strictly, the equation (2) is not established, thereby making it difficult to obtain the desired rate of reduction r in some cases. According to the present invention, in order to avoid the errors as described above, feedback control is performed by the use of the output thickness deviation. More specifically, in the case of ARC, a calculated output thickness deviation is obtained from the input thickness deviation $\Delta$Gi as $\Delta$Gi (1−r), the calculated output thickness thus obtained is compared with an actually measured output deviation $\Delta$Go, and the difference therebetween thus obtained is used as the correction value against the steady control disturbance. A correction value C in the following equation (7) is obtained every time after a plurality of n samplings have been conducted, and correction is carried out by the form of the equation (8).

$$C = \frac{\sum_{j=1}^{n}\Delta Go - \sum_{j=1}^{n}\Delta Gi(1-r)}{n} \quad (7)$$

$$Gic = \frac{Lo}{Li}\{Gos + \Delta Gi(1-r)\} + C \quad (8)$$

Additionally, in the case of AGC, the value of r is made to be 1 and correction may be carried out by use of the output thickness deviation $\Delta$Go itself.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein:

FIG. 2 is a block diagram showing the general control system of a first embodiment in which the method of automatically controlling the strip thickness according to the present invention is applied to a reversing mill;

FIG. 3 is a block diagram showing a more detailed control system of the reduction calculating circuit used in the abovedescribed first embodiment;

FIG. 4 is a block diagram showing the general control system of a second embodiment in which the method of automatically controlling the strip thickness according to the present invention is applied to a reversing mill;

FIGS. 5(*a*) and (*b*) are diagrams showing the comparison of the rolling results in a plurality of rolling passes between the prior art example and the second embodiment of the present invention;

FIG. 6 is a block diagram showing the reduction control system of a third embodiment in which the method of automatically controlling the rate of reduction according to the present invention is applied to a reversing mill;

FIG. 7 is a diagram showing an example of the changes in thickness deviation in the use of aforesaid third embodiment; and FIG. 8 is a diagram showing an example of the recorded results of the rate of reduction in the use of the aforesaid third embodiment.

DETAILED DESCRIPTION OF THE INVENTION

Figure 1A:
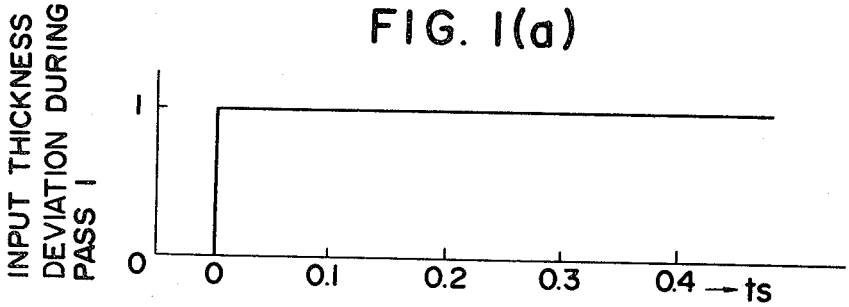
FIGS. 1(*a*)–(*d*) are diagrams in explanation of the principle of the present invention, in which comparison in strip thickness deviation is made between the continual use of AGC and the use of ARC after the use of AGC in the case the screwdown servo-system is approximately represented by a first order lag system having a delay time.
Figure 1B:
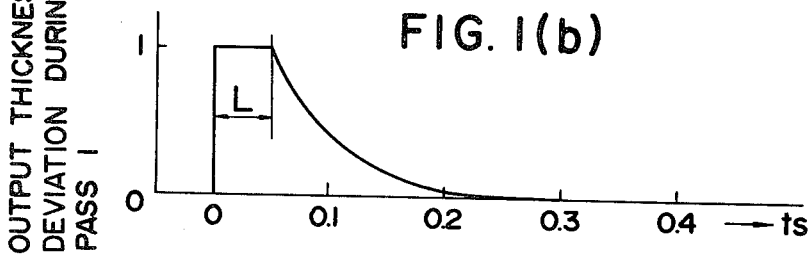
Figure 1C:
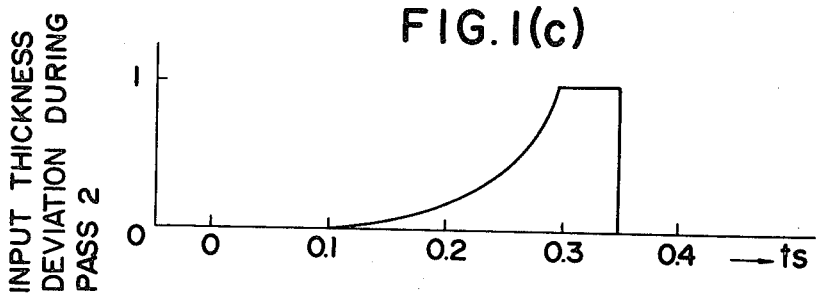
Figure 1D:
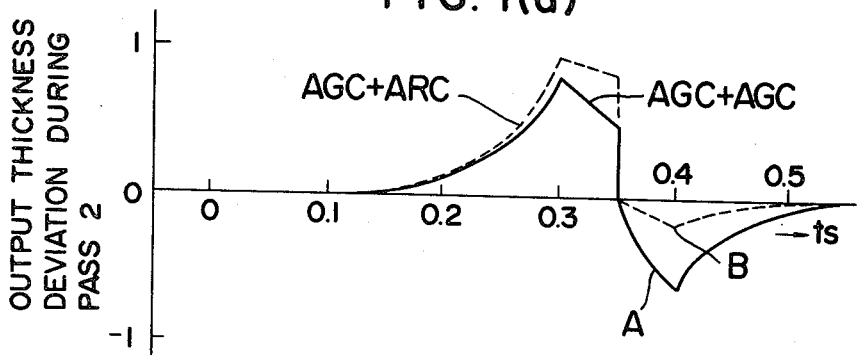

Detailed description will hereunder be given of the embodiments of the present invention with reference to the drawings.

FIG. 2 is a block diagram showing the general control system of a first embodiment in which the method of automatically controlling the strip thickness according to the present invention is applied to a reversing mill, and FIG. 3 is a block diagram showing a more detailed control system of the reduction calculating circuit used in the first embodiment. In this first embodiment, the input thickness is estimated through the equations (5) and (6) based on the principle of the constant mass-flow rate of the material being rolled as described above, and the screwdown system is controlled so that the difference between the estimated input thickness and the actually measured input thickness can be diminished to zero. In that case, AGC is used for control beyond a certain value of deviation, while, ARC is used for control below the abovedescribed value of deviation.

As shown in FIGS. 2 and 3, the abovedescribed first embodiment comprises:

an AGC input length detecting means, including a small touch roll 10 provided on the center line of a deflector roll 41, a pulse generator 11 for generating pulses in accordance with the rotation of the touch roll 10 and an AGC input length counter 12 for counting outputs from the pulse generator 11, for detecting an input length Li of a material 6 being rolled in a rolling mill 8 for the AGC mode;

ARC input length detecting means, including the aforesaid touch roll 10, pulse generator 11 and ARC input length counter 13, for successively detecting the input length Li of the material 6 for the ARC mode;

an input thickness gauge 31 for detecting an actually measured input thickness Gia of the material 6;

an input thickness deviation output circuit 33 for feeding a difference ΔGi between the actually measured input thickness Gia fed from the input thickness gauge 31 and an input thickness reference value Gis;

an input thickness deviation shift register 60 for storing the input thickness deviations ΔGi fed from the input thickness deviation output circuit 33, successively shifting same in accordance with the measured distances in response to output signals fed from the aforesaid input length counters, and feeding data immediately before the positions of work rolls;

a desired reduction output circuit 50 for calculating a desired rate of reduction r required for the ARC mode from the input thickness reference value Gis and the output thickness reference value Gos and feeding same;

an AGC output length detecting means, including a small touch roll 20 provided on the center line of a deflector roll 42, a pulse generator 21 for emitting pulses in accordance with the rotation of the touch roll 20, and an AGC output length counter 22 for counting outputs from the pulse generator 21, for detecting an output length Lo of the material 6 for the AGC mode;

an ARC output length detecting means, including the touch roll 20, the pulse generator 21 and an ARC output length counter 23, for detecting an output length Lo of the material 6 for the ARC mode;

a calculating circuit 70 including:

an AGC preset length output circuit 74 for feeding an AGC preset length Lis (AGC) corresponding to an input thickness reference value Gis to the AGC input length counter 12;

an ARC preset length output circuit 75 for feeding to the aforesaid ARC input length counter 13 an ARC preset length Lis (ARC) calculated from the input thickness reference value Gis, the desired rate of reduction r fed from the desired reduction output circuit 50 and the input thickness deviation ΔGi fed from the input thickness deviation output circuit 33;

a gate 73 for feeding an output when both the AGC input length counter 12 and the ARC input length counter 13 have completed detecting the preset lengths Lis;

an AGC output calculating circuit 71 for initiating calculation in response to an output from the gate 73, calculating through the equation (6) or (8) an estimated input thickness Gic (AGC) for the AGC mode from the input length Li (AGC) fed from the AGC input length counter 12, the output length Lo (AGC) from the AGC mode fed from the AGC output length counter 22 and the output thickness reference value Gos, and feeding an error signal ΔX (AGC) between the estimated input thickness Gic (AGC) and the actually measured input thickness Gia fed from the input thickness gauge 31;

an ARC output calculating circuit 72 for initiating calculation in response to an output from the gate 73, calculating through the equation (5) or (8) an estimated input thickness Gic (ARC) for the ARC mode from the input length Li (ARC) fed from the ARC input length counter 13, the output length Lo (ARC) for the ARC mode fed from the ARC output length counter 23, the input thickness deviation ΔGi immediately before the positions of work rolls fed from the input thickness deviation shift register 60, the output thickness reference value Gos and the desired rate of reduction r fed from the desired reduction output circuit 50, and feeding an error signal ΔX (ARC) between the estimated input thickness Gic (ARC) and the actually measured input thickness Gia fed from the input thickness gauge 31;

a comparator 76 for comparing the AGC error signal ΔX (AGC) fed from the aforesaid AGC output calculating circuit 71 with the reference error value ΔXs;

and an output selecting circuit 77, in response to an output from the comparator 76, for feeding the AGC error signal ΔX (AGC) fed from the AGC output calculating circuit 71 when the AGC error signal ΔX (AGC) exceeds the reference error value ΔXs or feeding the ARC error signal ΔX (ARC) fed from the ARC output calculating circuit 72 when the AGC error signal ΔX (AGC) does not reach the reference error value ΔXs;

a correction value calculating circuit 80 for obtaining a mean value of a difference between the output thickness reference value Gos and the actually measured output thickness Goa and feeding same as a feedback correction value C (AGC) for correcting error for the AGC mode, and obtaining a calculated output thickness deviation ΔGi (1−r) from the input thickness deviation ΔGi fed from the input thickness deviation output circuit 33 and the desired rate of reduction r fed from the desired reduction output circuit 50, calculating a feedback correction value C (ARC) for correcting an error for the ARC mode, from the calculated output thickness deviation ΔGi (1−r) and the actually measured output thickness deviation ΔGo through the equation (7) and feeding same to the calculating circuit 70; and a screwdown apparatus 90 for controlling the positions of the work rolls in response to an output ΔX fed from the output selecting circuit 77 of the calculating circuit 70, including a hydraulic cylinder 91 for adjusting the positions of work rolls, an electro - hydraulic servo-valve 92 for controlling the reduction action of the hydraulic cylinder 91 and a screwdown servomechanism 93 for controlling the servo-valve 92 in response to the error signal ΔX.

Description will hereunder be given of action of the first embodiment.

Explanation is given to the case that the rolling direction of a reversing mill is the direction indicated by an arrow D in FIG. 2. Length signals are fed from the pulse generator 11 for measuring the input lengths to the AGC input length counter 12 and the ARC input length counter 13, respectively. On the other hand, as shown in FIG. 3, both the counters 12 and 13, upon completing counting the preset lengths after receiving preset signals from the AGC preset length output circuit 74 and the ARC preset length output circuit 75, feed the count completion signals to the gate 73, respectively. Upon receiving the count completion signals from both the counters 12, 13, the gate 73 feeds an output to cause the AGC output calculating circuit 71 and the ARC output calculating circuit 72 to initiate calculation. In the drawing, signals fed from both the calculating circuits 71, 72 to both the output circuits 74, 75 are the succeeding preset command signals, respectively.

On the other hand, the input length Li is measured such that the number of rotations of the touch 10 provided on the center line of the deflector roll 41 disposed forwardly of the mill 8 is converted into pulses by means of the pulse generator 11 and counted by the AGC input length counter 12 and the ARC input length counter 13, respectively, and then, fed to the AGC output calculating circuit 71 and the ARC output calculating circuit 72 of the calculating circuit 70 as the digital or analog length signals Li (AGC) and Li (ARC).

Furthermore, the actually measured input thickness Gia is measured by means of the input thickness gauge 31 interposed between the deflector roll 41 and the positions of work rolls, compared with the input thickness reference value Gis in the thickness deviation output circuit 33, and the input thickness deviation ΔGi is stored in the input thickness deviation shift register 60. The input thickness deviations ΔGi thus stored are successively shifted in response to outputs from the counters 12, 13, i.e., in accordance with the measured distances, whereby the input deviation data immediately before the positions of work rolls are always fed from the shift register 60 to the AGC output calculating circuit 71 and the ARC output calculating circuit 72 of the calculating circuit 70.

The desired rate of reduction r used in calculation in the equation (5) for the ARC mode is calculated in the desired reduction calculation circuit 50 by use of the input and output reference values Gis and Gos set by an operator, and then, fed to the ARC preset length output circuit 75 as a constant.

The calculated input thickness Gic (AGC) and Gic (ARC) in the equations (6) and (5) are calculated in the calculating circuits 71, 72 from the abovedescribed various data, i.e., the input thickness deviation ΔGi, the input length Li, the output length Lo, the output thickness reference value Gos and the desired rate of reduction r at every sampling length of the input pulse generator 11.

The output lengths Lo (AGC) and Lo (ARC) are detected by means of the pulse generator 21 of the touch roll 20 being in contact with the deflector roll 42 at the output side of the mill 8, passed through the AGC output length counter 22 and the ARC output length counter 23, respectively, and fed to the AGC output calculating circuit 71 and the ARC output calculating circuit 72 of the calculating circuit 70 as the digital or analog length signals Lo (AGC) and Lo (ARC). As has been described hereinbefore, (Gic-Gia) for both the AGC and ARC modes are calculated in these output calculating circuits 71, 72 and the error signals ΔX (AGC) and ΔX (ARC) are emitted. As shown in FIG. 3, these error signals are fed to the output selecting circuit 77, and the error signals ΔX (AGC) fed from the AGC output calculating circuit 71 is fed to the comparator 76, where check is made whether the error signal ΔX (AGC) fed from the calculating circuit 71 exceeds the level of the reference error value ΔXs or not. When the error signal ΔX (AGC) exceeds the reference value ΔXs (5 μm, for example), the output selecting circuit 77 feeds the error signal ΔX (AGC) fed from the AGC output calculating circuit 71 to the screwdown servomechanism 93 of the screwdown apparatus 90. When the error signal ΔX (AGC) does not reach the reference value ΔXs, the error signal ΔX (ARC) is fed from the ARC output calculating circuit 72 to the screwdown servo-mechanism 93. The electric-hydraulic servovalve 92 controls the reduction action of the hydraulic cylinder 91 in a manner to diminish the error signal ΔX to zero at all times. Adoption of the screwdown mechanism having a high responsibility such as an electrohydraulic servo-system makes it possible to effect control of the positions of work rolls with high accuracy and high responsibility.

Description will not be given of the feedback mechanism for correcting errors in the rate of reduction due to the difference in diameter between the touch rolls at the input and output sides and the influence of the width spread of the material being rolled and the like. The actually measured thickness deviation ΔGo is obtained in the thickness deviation circuit 34 from the actually measured output thickness Go fed from the output thickness gauge 32 and the output thickness reference value Gos, a difference between the actually measured thickness deviation ΔGo and the calculated output deviation ΔGi (1-r) is added by a suitable times n in the correction value calculating circuit 80, and, when the number of added times reaches a value n, the mean value of the times n is taken according to the equation (7) to obtain the correction value C, which is fed to the calculating circuit 70. In the calculating circuit 70, the estimated input thickness Gic is corrected according to the equation (8). The abovedescribed calculation circuits or the shift register may be constituted by analog or digital circuits as in the illustrated embodiment, or may be constituted by computer systems.

In addition, in the embodiment described above, description has been given of the rolling in one direction in a reversing mill, however, it is applicable to the rollings in the reversing directions.

FIG. 4 is a block diagram showing the general control system of the second embodiment, in which the method of automatically controlling the strip thickness according to the present invention is applied to a reversible rolling mill.

As shown in FIG. 4, the abovedescribed second embodiment comprises:

input length detecting means, including a small touch roll 10, a pulse generator 11 and an input length counter 101 similarly to the first embodiment, for detecting an input length Li of a material 6 being rolled in the mill 8;

an input thickness gauge 31 similar to the first embodiment, for detecting an actually measured input thickness Gia of the material 6;

an input thickness deviation output circuit 33 similar to the first embodiment, for feeding a difference ΔGi between the actually measured input thickness Gia fed from the input thickness gauge 31 and an input thickness reference value Gis;

output length detecting means, including a small touch roll 20, a pulse generator 21 and an output length counter 111 similarly to the first embodiment, for detecting an output length Lo of the material 6;

an AGC calculating circuit 120 for calculating an estimated input thickness Gic (AGC) for the AGC mode through the equation (6) from the input length Li fed from the input length counter 101, the output length Lo fed from the output length counter 111 and an output thickness reference value Gos, and feeding an error signal ΔX (AGC) between the estimated input thickness Gic (AGC) and the actually measured input thickness Gia fed from the input thickness gauge 31;

an ARC calculating circuit 130 for calculating an estimated input thickness Gic (ARC) for the ARC mode through the equation (5) from the input length Li fed from the input length counter 101, the input thickness deviation ΔGi fed from the input thickness deviation output circuit 33, the output length Lo fed from the output length counter 111, the output thickness reference value Gos and a desired rate of reduction r calculated from the input thickness reference value Gis and the output thickness reference value Gos, and feeding an error signal ΔX (ARC) between the estimated input thickness Gic (ARC) and the actually measured input thickness Gia fed from the input thickness gauge 31;

a mode selection circuit 140, according to the predetermined control modes for the respective rolling passes, for feeding for the AGC mode the AGC error signal ΔX (AGC) fed from the AGC calculating circuit 120 or feeding for the ARC mode the ARC error signal ΔX (ARC) fed from the ARC calculating circuit 130; and a screwdown apparatus 90 including a hydraulic reduction cylinder 91, an electro-hydraulic servo-valve 92 and a screwdown servo-mechanism 93 similarly to the first embodiment, for controlling the positions of the work rolls in response to an output from the mode selection circuit 140.

In the drawing, designated at 32 is a thickness gauge for detecting an input thickness during reversing rollings and 34 a thickness deviation output circuit for calculating an input thickness deviation also during reversing rollings.

Description will hereunder be given of action of the second embodiment.

Now, suppose the rolling direction of a pass is the direction indicated by an arrow D. Firstly, the input length Li is measured such that the number of rotations of the touch roll 10 provided on the center line of the deflector roll 41 disposed forwardly of the mill 8 is converted into pulses by means of the pulse generator 11 and counted by means of the input length counter 101, and this signal is fed to the AGC calculating circuit 120 and the ARC calculating circuit 130, respectively. The actually measured input thickness Gia is detected by means of the input thickness gauge 31 interposed between the deflector roll 41 and the positions of work rolls. This actually measured input thickness Gia and the input thickness reference value Gis are fed to the input thickness deviation output circuit 33, where the input thickness deviation ΔGi is calculated and fed to the aforesaid calculating circuits 120 and 130, respectively. The input and output thickness refernce values Gis or/and Gos are likewise fed to the calculating circuits 120 and 130, respectively, where the aforesaid data are used to calculate the estimated input thickness Gic (AGC), Gic (ARC) through the aforesaid equations (6) and (5). Furthermore, the output length Lo is likewise measured by means of the touch roll 20 provided on the center line of the deflector roll 42 disposed at the output side, the pulse generator 21 and the output length counter 11, and is fed to the calculating circuits 120 and 130, respectively. In the calculating circuits 120 and 130, the error signals ΔX (AGC), ΔX (ARC) between the aforesaid estimated input thickness Gic (AGC), Gic (ARC) and the actually measured input thickness Gia are calculated and fed to the mode selection circuit 140. The mode selection circuit 140 includes a mode selection switch and a mode setter, according to the predetermined control modes for the respective modes, is adapted to feed for the AGC mode the error signal ΔX (AGC) and for the ARC mode the error signal ΔX (ARC) to the screwdown servo-mechanism 93 of the screwdown apparatus 90 to cause the hydraulic cylinder 91 to adjust the work rolls, through the electro-hydraulic servo-valve 92, so that the strip thickness can be controlled.

When the rolling direction is changed over to a direction opposite to the direction indicated by the arrow D, the aforesaid input side and output side are turned around, the input thickness deviation in this case is calculated from the input thickness fed from the thickness gauge 32 and the input thickness reference value by means of the thickness deviation output circuit 34, fed to the calculating circuits 120 and 130, respectively, and a control output for the control mode selected is given to the screwdown apparatus 90 in the same manner as aforesaid.

In addition, the aforesaid calculating circuits 120 and 130 may display the functions by use of only a computer system.

Table 1 shows one example of a rolling pass schedule according to the present invention.

TABLE 1

| Pass mode | 1 | 2 | 3 | 4 | 5 | 6 |
|---|---|---|---|---|---|---|
| Three passes | AGC | ARC | AGC | | | |
| Four passes | AGC | AGC | ARC | AGC | | |
| Five passes | AGC | ARC | AGC | ARC | AGC | |
| Six passes | AGC | AGC | ARC | AGC | ARC | AGC |

Namely, in a pass schedule of an odd number, the first pass is controlled in the AGC mode, and thereafter, the ARC mode and the AGC mode alternate for control. In a pass schedule of an even number, the first and second passes are controlled in the AGC modes, and, from the third pass on, the ARC mode and the AGC mode alternate for control. By this, both in the pass schedules of the odd and even numbers, the last pass is controlled in the AGC mode, and the pass immediately before last is controlled in the ARC mode, so that the accuracy in strip thickness can be improved with the increase in number of passes. Additionally, in the case of a multiplicity of passes, the former part of passes are controlled in the AGC mode, the latter part of passes except the last one are controlled in the ARC mode, and the last pass is controlled in the AGC mode, thus enabling to achieve the satisfactory results.

FIG. 5 shows the results of rollings in a plurality of passes by the relationship between the percentage of number of coils and the percentage of coil lengths included within a strip thickness deviation of $\pm 5$ $\mu$m. FIG. 5(*a*) shows the case where only the AGC modes are consequently used like in the prior art and FIG. 5(*b*) shows the case where ther AGC and ARC modes are alternately used according to the present invention. As is apparent from these drawings, use of the method according to the present invention appreciably improves the accuracy in strip thickness, brings about the stability in quality, and moreover, improved productivity due to increased rolling speed.

In the abovedescribed embodiments, only the cases of the reversing mills are described, but the present invention can be likewise applicable to the tandem mills too. Furthermore, either the AGC mode or the ARC mode are desirably applicable, and is not limited to one using the abovedescribed principle of the constant mass-flow rate of the material being rolled.

FIG. 6 is a block diagram showing a third embodiment of the reduction control system in which the method of automatically controlling the rate of reduction according to the present invention is applied to a reversing mill.

As shown in FIG. 6, the abovedescribed third embodiment comprises:

input length detecting means including a small touch roll 10, a pulse generator 11 and an input length counter 101 similarly to the second embodiment, for detecting an input length Li of a material 6 being rolled in the mill 8;

an input thickness gauge 31 similar to the first embodiment, for detecting an actually measured input thickness Gia of the material 6;

an input thickness deviation output circuit 33 similar to the first embodiment, for feeding a difference ΔGi between the actually measured input thickness Gia fed from the input strip thickness gauge 31 and an input thickness reference value Gis;

an input thickness deviation shift register 60 similar to the first embodiment, for storing the input thickness deviation ΔGi fed from the input thickness deviation output circuit 33, successively shifting same in accordance with the measured distances in response to output signal fed from the aforesaid input length counter 101, and feeding data immediately before the positions of work rolls;

a desired reduction output circuit 50 similar to the first embodiment, for calculating a desired rate of reduction r from the input thickness reference value Gis and an output thickness reference value Gos and feeding same;

output length detecting means including a small touch roll 20, a pulse generator 21 and an output length counter 111 similarly to the second embodiment, for detecting an output length Lo of the material 6;

a calculating circuit 150 for initiating calculation each time a predetermined length is detected by means of the input length counter 101, calculating an estimated input thickness Gic (ARC) through the aforesaid equation (5) or (8) from the input length Li fed from the input length counter 101, the output length Lo fed from the output length counter 111, the input thickness deviation ΔGi immediately before the positions of work rolls fed from the input thickness deviation shift register 60, the output thickness reference value Gos and the desired rate of reduction r fed from the desired reduction output circuit 50, and feeding an error signal ΔX (ARC) between the estimated input thickness Gic (ARC) and the actually measured input thickness Gia fed from the input thickness gauge 31;

a correction value calculating circuit 80 for obtaining a calculated output thickness deviation ΔGi (1-r) from the input thickness deviation ΔGi fed from the input thickness deviation output circuit 33 and the desired rate of reduction r fed from the desired reduction output circuit 50, calculating a feedback correction, value C for correcting an error from the calculated output thickness deviation ΔGi (1−r) and the actually measured output thickness deviation ΔGo through the equation (7), and feeding same to the calculating circuit 150;

a screwdown apparatus 90 including a hydraulic cylinder 91, and electo-hydraulic servo-valve 92 and a screwdown servo-mechanism 93 similarly to the first embodiment, for controlling the positions of the work rolls in accordance with the error signal ΔX (ARC) fed from the calculating circuit 150; and a recorder 160 and an indicator 161 for recording and indicating a rate of reduction $$\frac{Lo - Li}{Lo}$$

calculated from the input length Li and the output length Lo in the calculating circuit 150.

Description will hereunder be given of action of the third embodiment.

Firstly, the input length Li is measured such that the number of rotations of the touch roll 10 provided on the center line of the deflector roll 41 disposed forwardly of the mill 8 is converted into pulses by means of the pulse generator 11 and counted by means of the input length counter 101. The digital or analog input length Li thus obtained is fed to the calculating circuit 150.

Subsequently, the actually measured input length Gia is measured by means of the input strip thickness gauge 31 interposed between the deflector roll 41 and the positions of work rolls, compared with the input thickness reference value Gis in the thickness deviation output circuit 33, and the input thickness deviation ΔGi thus obtained is fed to the input thickness deviation shift register 60. The input thickness deviations ΔGi thus supplied are successively shifted in response to outputs from the input length counter 101, whereby the input thickness deviation ΔGi immediately before the positions of work rolls is fed from the shift register 60 to the calculating circuit 150.

The desired rate of reduction r is calculated from the input and output thickness reference signals Gis and Gos, which have been set by the operator, in the desired reduction calculating circuit 50, and then, fed to the calculating circuit 150 as a constant.

The output length is detected by means of the pulse generator 21 of the touch roll 20 being in contact with the deflector roll 42 disposed at the output side of the mill 8, passed through the output length counter 111, and fed to the calculating circuit 150 as the digitial or analong output length signal Lo. In the calculating circuit 150, an estimated input thickness Gic is calculated through the equation (5) from the abovedescribed various data, i.e., the input length Li, the output length Lo, the input thickness deviation ΔGi, the output thickness reference value Gos, and the desired rate of reduction r at every sampling length of the input pulse generator 11, an error signal ΔX (ARC) between the estimated input thickness Gic and the aforesaid actually measured input thickness Gia is fed to the screwdown servo-mechanism 93 of the screwdown apparatus 90. The electro-hydraulic servo-valve 92 controls the reduction action of the hydraulic cylinder 91 in a manner to diminish the aforesaid error signal ΔX (ARC) to zero at all times.

In addition, the feedback mechanism for correcting errors in the rate of reduction due to the difference in diameter between the touch rolls at the input and output sides and the influence of the width spread of the material being rolled is similar to that in the aforesaid first embodiment, so that description thereof will be omitted.

The rate of reduction is usually represented by (Gi-Go)/Gi. However, since the position of the thickness gauge is spaced apart from the position of rolling reduction, it is necessary to allow the material 6 to reach the thickness gauge disposed at the output side before the true rate of reduction can be obtained. Consequently, to use the strip thickness as the representation of the rate of reduction, the complicated mechanism of the tracking system is necessary and the response becomes low. Therefore, in this invention the rate of reduction is easily obtained by calculating (Lo-Li)/Lo from the actually measured lengths through the equation (2). The recorder 160 and the indicator 161 respectively record or indicate the rate of reduction $$\frac{Lo - Li}{Lo}$$

which has been calculated in the aforesaid calculating circuit 150.

The respective calculating circuits and shift register are constituted by analong or digital circuits as shown in the embodiment, but on the contrary, they may be constituted by a computer system.

FIGS. 7 and 8 are recording charts showing the deviation of strip thickness and the rate of reduction in the case of applying the third embodiment of the present invention. FIG. 7 shows an example where a test coil being of a trapezoidal shape and having a strip thickness of approx. ±10 μm is rolled at a certain rate of reduction, in which is best shown the condition that the change in output thickness indicated by D follows the change in input thickness indicated by E. Additionally, according to the record of the rate of reduction, it is found that the material is rolled within ±1.0% with respect to the desired value 9%.

It should be apparent to those skilled in the art that the abovedescribed embodiments are merely representative of the applications to which the principles of the present invention may be applied. Numerous and varied other arrangements can be readily devised by those skilled in the art without departing from the spirit and the scope of the invention.

What is claimed is:

1. The method of automatically controlling the rate of reduction in a rolling mill comprising the steps of: rolling a material at a predetermined rate of reduction, controlling the rate of reduction in such a manner that an output thickness of the material being rolled is calculated from an actually measured input thickness of the material and a desired rate of reduction, estimating an input thickness from the output thickness thus calculated, an input length and an output length based on the principle of constant mass-flow rate of the material being rolled, such that the difference between the estimated input thickness and an actually measured input thickness can be diminished to zero.

2. The method according to claim 1, wherein said estimated input thickness is feedback corrected by a correction value obtained by adding and averaging a difference between a calculated output thickness deviation and an actually measured thickness deviation of the material being rolled over a predetermined length of the material.

3. A device for automatically controlling the strip thickness in a rolling mill, comprising:

AGC input length detecting means for detecting an input length of a material being rolled for an AGC mode;

ARC input length detecting means for detecting an input length of the material for an ARC mode;

input thickness detecting means for detecting an actually measured input thickness of the material;

an input thickness deviation output circuit for feeding a difference between the actually measured input thickness fed from the input thickness detecting means and an input thickness reference value;

an input thickness deviation shift register for storing the input thickness deviations fed from the input thickness deviation output circuit, successively shifting same in accordance with measured distances in response to output signals fed from said input length detecting means, and feeding the input thickness deviation data immediately before the positions of work rolls;

a desired reduction output circuit for feeding a desired rate of reduction required for the ARC mode;

AGC output length detecting means for detecting an output length of the material for the AGC mode;

ARC output length detecting means for detecting an output length of the material for the ARC mode;

a calculating circuit including:

an AGC preset length output circuit for feeding an AGC preset length in accordance with the input thickness reference value to said AGC input length detecting means;

an ARC preset length output circuit for feeding to said ARC input length detecting means an ARC preset length calculated from the input thickness reference value, the desired rate of reduction fed from the desired reduction output circuit and the input thickness deviation fed from the input thickness deviation output circuit;

a gate for emitting an output when both the AGC input detecting means and the ARC input length detecting means have completed detections of the preset lengths;

an AGC output calculating circuit for initiating calculation in response to an output from the gate, calculating an estimated input thickness of the AGC mode from the input length fed from the AGC input length detecting means, the output length fed from the AGC output length detecting means and the output thickness reference value, and feeding an error signal between the estimated input thickness and the actually measured input thickness fed from the input thickness detecting means;

an ARC output calculating circuit for initiating calculation in response to an output from the gate, calculating an estimated input thickness of the ARC mode from the input length fed from the ARC length detecting means, the output length fed from the ARC output length detecting means, the input thickness deviation immediately before the positions of work rolls fed from the input thickness deviation shift register, the output thickness reference value and the desired rate of reduction fed from the desired reduction output circuit, and feeding an error signal between the estimated input thickness and the actually measured input thickness fed from the input thickness detecting means;

a comparator for comparing an AGC error signal fed from the AGC output calculating circuit with the deviation reference value;

an output selecting circuit for feeding the AGC error signal fed from the AGC output calculating circuit when the error signal exceeds the reference deviation and feeding the ARC error signal fed from the ARC output calculating circuit when the difference signal does not reach the reference deviation, in response to an output from the comparator; and a reduction apparatus for controlling the positions of work rolls in response to an output from the output selecting circuit of the calculating circuit.

4. The device according to claim 3, wherein a correction value calculating circuit is further included for obtaining a mean value of a difference between the output thickness reference value and the actually measured output thickness and feeding same as a feedback correction value for correcting error for the AGC mode, and obtaining a calculated output thickness deviation from the input thickness deviation fed from said input thickness deviation output circuit and the desired rate of reduction fed from said desired reduction output circuit and feeding a mean value of a difference between the calculated output thickness deviation and the actually measured thickness deviation to said reduction calculating circuit as a feedback correction value for correcting an error for the ARC mode.

5. The device according to claim 3 or 4, wherein said desired reduction output circuit is made to calculate the desired rate of reduction from the input thickness reference value and the output thickness reference value.

6. A device for automatically controlling the strip thickness in a rolling mill, comprising:

input length detecting means for detecting an input length of a material being rolled;

input thickness detecting means for detecting an actually measured input thickness of the material;

an input thickness deviation output circuit for feeding a difference between the actually measured input thickness fed from the input thickness detecting means and an input thickness reference value;

output length detecting means for detecting an output length of the material;

an AGC calculating circuit for calculating an estimated input thickness for the AGC mode from the input length fed from the input length detecting means, the output length fed from the output length detecting means and an output thickness reference value, and feeding an error signal between the estimated input thickness and the actually measured input thickness fed from the input thickness detecting means;

an ARC calculating circuit for calculating an estimated input thickness for the ARC mode from the input length fed from the input length detecting means, the output length fed from the output length detecting means, the input thickness deviation fed from the input thickness deviation output circuit, the output thickness reference value and a desired rate of reduction calculated from the input thickness reference value and the output thickness reference value, and feeding an error signal between the estimated input thickness and the actually measured input thickness fed from the input thickness detecting means;

a mode selection circuit for feeding an AGC error signal fed from the AGC calculating circuit at the time of the AGC mode and feeding an ARC error signal fed from the said ARC calculating circuit at the time of the ARC mode, in accordance with the control mode predetermined for the respective rolling passes; and a reduction apparatus for controlling the positions of work rolls in response to an output from the mode selection circuit.

7. A device for automatically controlling the rate of reduction in a rolling mill, comprising:

input length detecting means for detecting an input length of a material being rolled;

input thickness detecting means for detecting an actually measured input thickness of the material;

an input thickness deviation output circuit for feeding a difference between the actually measured input thickness fed from the input thickness detecting means and an input thickness reference value;

an input thickness deviation shift register for storing the input thickness deviations fed from the input thickness deviation output circuit, successively shifting same in accordance with measured distances in response to an output signal fed from said input length detecting means, and feeding the input thickness deviation data immediately before the positions of work rolls;

a desired reduction output circuit for feeding a desired rate of reduction;

output length detecting means for detecting an output length of the material;

a calculating circuit for initiating at least one calculation each time a predetermined length is detected by means of said input length detecting means, calculating an estimated input thickness from the input length fed from said input length detecting means, the output length fed from said output length detecting means, the input thickness deviation immediately before the positions of work rolls fed from said input thickness deviation shift register, the output thickness reference value and the desired rate of reduction fed from the desired reduction output circuit, and feeding a difference between the estimated input thickness and the actually measured input thickness fed from said input thickness detecting means; and a reduction apparatus for controlling the positions of work rolls in response to an output from the calculating circuit.

8. The device according to claim 7, wherein a correction value calculating circuit is further included for obtaining a calculated output thickness deviation from the input thickness deviation fed from said input thickness deviation output circuit and the desired rate of reduction fed from said desired reduction output circuit, and feeding a mean value of a difference between the calculated output thickness deviation and the actually measured output thickness deviation to said calculating circuit as a feedback correction value.

9. The device accroding to claim 7, wherein reduction indicating means is further included for indicating a rate of reduction calculated from the input length and output length.

10. The device according to claims 7 or 8, wherein said desired reduction output circuit is made to calculate a desired rate of reduction from the input thickness reference value and the output thickness reference value.

11. A method of automatically controlling strip thickness of a material being rolled in a rolling mill for producing a rolled product having a desired thickness, comprising the steps:

(a) selecting an automatic gauge control (AGC) mode when said material being rolled is in a first rolling condition;

(b) selecting an automatic reduction rate control (ARC) mode when said material being rolled is in a second rolling condition;

(c) passing said material being rolled through said automatic gauge control mode when said automatic gauge control mode is selected, such that a deviation between an output thickness of said material being rolled and a predetermined desired uniform gauge thickness is diminished to zero; and (d) passing said material being rolled through said automatic reduction rate control when said automatic reduction rate control mode is selected, such that a predetermined rate of reduction of said material being rolled is obtained.

12. The method according to claim 11, further comprising the step of setting a reference deviation between the output thickness of the material being rolled and a desired uniform gauge thickness, wherein said first rolling condition exists when an actually measured deviation of the output thickness exceeds said reference deviation and said second rolling condition exists when said actually measured deviation of the output thickness is less than said reference deviation.

13. The method according to claim 11, wherein if a total number of rolling passes is an odd number of three or more, then said first rolling condition exists in pass 1, and said second rolling condition and said first rolling condition alternatively exist in pass 2 and thereafter.

14. The method according to claim 11, wherein if a total number of rolling passes is an even number of four or more, then said first rolling condition exists in passes 1 and 2, and said second rolling condition and said first rolling condition alternatively exist in pass 3 and thereafter.

15. The method according to claim 11, wherein said first rolling condition exists in a first group of rolling passes and in a final rolling pass, and said second rolling condition exists in a second group of rolling passes, subsequent to said first group of rolling passes.

16. The method according to one of claims 11, 12, 13, 14 or 15, wherein said ARC mode is adapted to control the rate of reduction in such a manner that an output thickness of the material being rolled is calculated from an actually measured thickness of the material at the input side of the mill and the desired rate of reduction, an input thickness is estimated from the output thickness thus calculated, an input length and an output length based on the principle of the constant mass-flow rate of the material being rolled, such that the difference between the estimated input thickness and an actually measured input thickness can be diminished to zero.

* * * * *